US008651938B2

(12) United States Patent
Iremonger et al.

(10) Patent No.: US 8,651,938 B2
(45) **Date of Patent: *Feb. 18, 2014**

(54) GAMING MACHINE HAVING A SIMULATED MUSICAL INTERFACE

(71) Applicant: Bally Gaming, Inc., Las Vegas, NV (US)

(72) Inventors: Barry Iremonger, Reno, NV (US); Keshav Pitani, Reno, NV (US); Loren T. Nelson, Reno, NV (US); Rajaraman Ramachandran, Bangalore (IN); Nishant Singh, Bangalore (IN); Umashankar Chikkahonnaiah, Bangalore (IN); Sandeep Surendran, Bangalore (IN)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/735,538

(22) Filed: Jan. 7, 2013

(65) Prior Publication Data

US 2013/0157759 A1 Jun. 20, 2013

Related U.S. Application Data

(63) Continuation of application No. 13/326,195, filed on Dec. 14, 2011, now Pat. No. 8,371,923.

(51) Int. Cl.
*A63F 9/24* (2006.01)

(52) U.S. Cl.
USPC ..... 463/19; 463/25

(58) Field of Classification Search
USPC ..... 463/16–25, 31–43; 273/138 R, 191, 292
See application file for complete search history.

(56) References Cited

U.S. PATENT DOCUMENTS

| | | | |
|---|---|---|---|
| 7,481,707 | B1 | 1/2009 | Luciano et al. |
| 7,794,319 | B2 | 9/2010 | Luciano et al. |
| 2003/0140770 | A1 | 7/2003 | Barry |
| 2006/0166728 | A1 | 7/2006 | Cornell et al. |
| 2009/0137305 | A1 | 5/2009 | Luciano et al. |
| 2009/0186692 | A1 | 7/2009 | Thomas et al. |
| 2009/0312102 | A1 | 12/2009 | Oberg et al. |
| 2010/0184497 | A1 | 7/2010 | Cichowlas |
| 2010/0235285 | A1 | 9/2010 | Hoffberg |
| 2010/0261518 | A1 | 10/2010 | Randall |
| 2010/0273555 | A1 | 10/2010 | Beerhorst |
| 2011/0009180 | A1 | 1/2011 | Luciano et al. |

*Primary Examiner* — Masud Ahmed
(74) *Attorney, Agent, or Firm* — Brooke Quist; Marvin Hein

(57) ABSTRACT

A simulated musical interface associated with a gaming machine enhances player excitement and interaction with the gaming machine. In one embodiment, the simulated musical interface is associated with a game in which the player uses the interface to play a simulated instrument on a gaming machine to affect, or apparently affect, the outcome of the game. As the player plays the simulated instrument via the simulated musical interface, indicia or graphical representations may be generated for a game of chance on a display associated with the gaming machine.

22 Claims, 9 Drawing Sheets

GAMING MACHINE HAVING A SIMULATED MUSICAL INTERFACE

CROSS-REFERENCE TO RELATED APPLICATIONS

This application is a continuation of U.S. patent application Ser. No. 13/326,195 filed Dec. 14, 2011 entitled GAMING MACHINE HAVING A SIMULATED MUSICAL INTERFACE, which is herein incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

This description relates to wagering games, gaming machines, networked gaming systems and methods and, more particularly, to wagering games, gaming machines, networked gaming systems and methods having a simulated musical interface.

BACKGROUND

Gaming devices, such as casino gaming devices (e.g., slot machines), have been popular for a long period of time. Initially, such devices were mechanical devices presenting one or more mechanical spinning reels to randomly select and display winning or losing outcomes on a single pay line. Modernly, such devices are computer controlled and some include video displays, electro-mechanical stepper controlled physical reels, or combinations thereof. Typically, these devices display game features of a base game and one or more bonus or secondary games. For example, for a video device, the game may present a base game depicting video images of five reels each with three display positions (i.e., coordinates producing a 3×5 matrix of positions for symbols). One or more pay lines are provided. Under control of the computer processor, the video display depicts the reel game. For example, the video display depicts spinning reels, which eventually come to a stop. Each reel has one or more symbols arranged thereon. Upon stopping, some of the symbols fall within the matrix. These symbols are compared against one or more predetermined winning combinations of symbols for each pay line within the matrix on a wagered upon (i.e., enabled) pay line. Receiving a winning combination on a wagered upon pay line results in a prize (e.g., credit award, monetary award, tournament bonus points, and the like).

Secondary games may include free spins of the base game, alteration of the base game for a number of spins (e.g., making one or more symbols wild or altering the symbol sets for the reels), a game where a player makes selections to reveal one or more prizes or otherwise interacts with a game feature to produce, or try to produce, an additional award.

While the use of various secondary games can increase player anticipation, interest, and satisfaction, there remains a need for games that provide a player with enhanced excitement. In particular, there remains a need for a game in which a player interacts with the game in a new and entertaining way.

SUMMARY

Briefly, and in general terms, various embodiments are directed to a simulated musical interface associated with a game for play by a player of a gaming machine.

In one embodiment, a computer-implemented method for playing a secondary game in association with a primary wagering game is disclosed. This method includes: presenting a simulated musical interface on the gaming machine associated with one or more activatable regions on which the one or more activatable regions associated with the simulated musical interface are activatable by a player; providing graphical representations on the display of the gaming machine upon the player activating an activatable region associated with the simulated musical interface; and generating one or more outcomes for the secondary game based on the player's activation of the one or more activatable regions associated with the simulated musical interface and the graphical representations.

In another embodiment, a computer-implemented gaming machine includes a display for presenting a primary game and a bonus game to a player and one or more player input devices for receiving player input. In this embodiment, at least one of the one or more player input devices is configurable to operate as a simulated musical interface on the gaming machine. Additionally, the simulated musical interface has one or more regions that are activatable by the player. Continuing, graphical representations are presented on the display of the gaming machine. One or more outcomes for the secondary game are generated based on the player's activation of the one or more activatable regions associated with the simulated musical interface and the graphical representations.

In still another embodiment, a computer-implemented gaming system includes a plurality of gaming machines connected to a server over a network and a collaborative or tournament game presented on the plurality of gaming machines or a group within the plurality of gaming machines. Each gaming machine has a simulated musical interface. The simulated musical interface of each gaming machine has one or more regions that are activatable by a player. Additionally, graphical representations are presented on each gaming machine. Continuing, one or more outcomes for the secondary game are generated based on the player's activation of the one or more activatable regions associated with the simulated musical interface and the graphical representations. The simulated musical interface is associated with the collaborative or tournament game.

In accordance with one or more embodiments, a gaming machine, such as a slot machine, includes an interface activatable by a player and a primary game comprising one or more game plays. At least one of the game plays may occur after activation of the interface by the player. A set of indicia may be displayed according to a primary game outcome. The game may include a bonus whereby a player uses a simulated musical interface, such as a video piano keyboard or other musical instrument. At the beginning of the bonus, a set of bonus reel(s) with no symbols may be shown to the player. During the bonus, the player may be prompted by a control program as to which musical note to play and when to play it. Each time the player plays a correct note, the game may place a symbol on the bonus reel(s). This symbol may be a graphical icon or a numerical value or any such object. This symbol may be selected randomly or by a predefined algorithm. The location on the bonus reel(s) the symbol occupies may be determined randomly or by a predefined algorithm. The symbol may travel to its destination on the bonus reel(s) along a random or predetermined path, or may instantly appear in the proper location. The player may continue to play the bonus until the bonus reel(s) have been populated with a certain number of symbols, until a specific amount of time has passed, or until some other factor determines the play is finished. Once the player has finished playing the simulated musical instrument, the bonus reel(s) spin to one or more outcomes, and the player is awarded a bonus amount based on the result of the bonus spin. The bonus reel(s) may be any device commonly used in gaming environments, such as one or more slot reels, wheels, dice, cards, or other representations of objects used to produce random outcomes.

The foregoing summary does not encompass the invention in its entirety, nor are the embodiments intended to be limiting. Rather, the embodiments are provided as mere examples.

DETAILED DESCRIPTION

Figure 1:
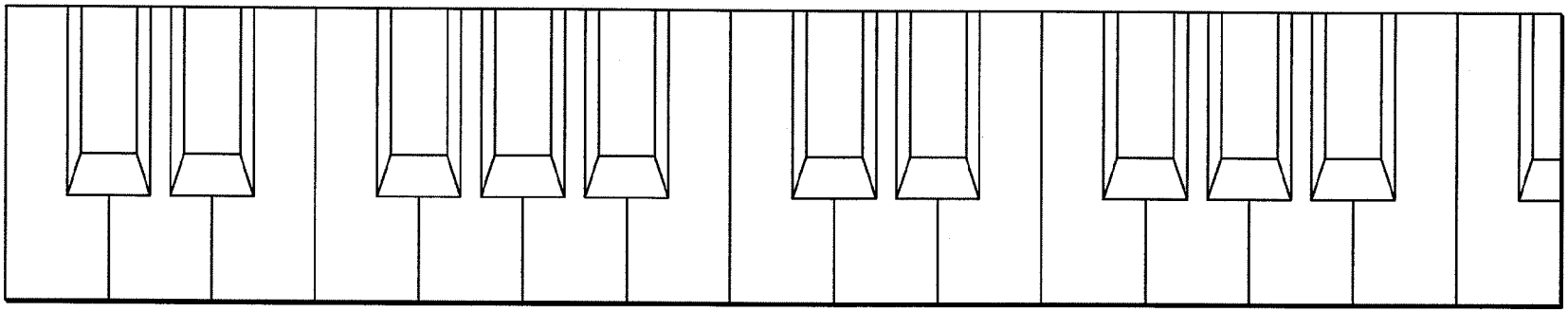
FIG. 1 illustrates one embodiment of a simulated musical interface.

Referring now to the drawings, wherein like reference numerals denote like or corresponding parts throughout the drawings and, more particularly to FIGS. 1-4, there are shown various embodiments of systems and methods for simulating a musical interface on a gaming machine.

More specifically, FIGS. 1-4 illustrate various embodiments of a simulated musical interface 100 presented on a gaming machine. The gaming machine may present a game of chance or skill. The simulated musical interface 100 may be presented on one or more primary game displays, on one or more secondary game displays, a touch screen video button deck (e.g., the iDeck™ by Bally Technologies, Inc.), or a combination thereof. The touch screen button deck may be reconfigured to present the simulated musical interface. For example, during play of a primary game, the touch screen button deck may present player inputs, such as wagering buttons. However, during play of a bonus game associated with the simulated musical interface 100, the touch screen button deck may be reconfigured to present the simulated musical interface.

In some embodiments, the simulated musical interface 100 may be associated with a bonus game. In other embodiments, the simulated musical interface 100 may be a requisite component associated with a primary game that must be triggered to obtain certain results from the primary game. In yet other embodiments, the simulated musical interface 100 may be associated with a tournament game that may be played against one or more computer-controlled "players" and/or one or more actual players. In other embodiments, the simulated musical interface may be associated with a collaborative game. For example, a plurality of players may be required to "play" their respective simulated musical interfaces together to create a musical compilation including data (e.g., music) generated by each player. In these embodiments, one or more displays or video button decks may present the simulated musical interface 100 and the game(s) associated therewith. For example, a gaming machine may present the simulated musical interface 100 on a video button deck and a corresponding game on a primary or secondary display. As another example, a gaming machine may present the simulated musical interface 100 and a game associated with it on the same display. This display may utilize touch screen technology. If not, the simulated musical interface 100 presented on the display may be controlled by player input devices, such as wagering buttons and the like.

In one embodiment, the simulated musical interface 100 (or the game associated therewith) may be triggered, or otherwise activated, based on one or more player inputs (e.g., pattern of play); one or more primary game results (e.g., a win amount, presence of one or more symbols, and the like); one or more bonus game results; one or more tournament game results; player points; tournament points; game specific points; accumulation of game pieces across multiple gaming machines hosting the same game or different games that may be of different genre; and any combination thereof. In other embodiments, the simulated musical interface 100 may be activated on a plurality of gaming machines simultaneously for tournament or collaborative play.

For example, the player may activate the simulated musical interface 100 by wagering a max bet 5 times in a row, 10 times in a row, 20 times in a row, and the like. This provides an incentive for the player to wager the maximum amount. The simulated musical interface 100 may also be triggered based on time. For example, the simulated musical interface 100 may be triggered fifteen minutes past every hour, after ten minutes of game play, or after specified game play. Specified game play may include wagering a predetermined amount of credits within a certain time period (e.g., 60 seconds, 2 minutes, 5 minutes, an hour, a day, and the like). Thus, a slow player may trigger the simulated musical interface by placing the max bet for every wager whereas a fast player may also trigger the simulated musical interface by wagering smaller amounts in an, expedited manner.

The manner in which the simulated musical interface 100 (or the game associated therewith) is triggered may affect, for example, the length of time that the simulated musical interface is presented to the player, the award(s) winnable by the player, and if the associated game is activated with the simulated musical interface 100. In some embodiments, the player may be required to use the simulated musical interface 100 in such a way that activates the associated game. For example, the player may be required to "play" the simulated musical interface 100 to output a certain song in compliance with the requirements of the gaming machine in order to activate the associated game(s). In another example, the player may be required to go through a tutorial associated with the simulated musical interface 100 to ensure the player understands how to operate the simulated musical interface to activate the associated game. As yet another example, the player may be required to calibrate the simulated musical interface 100 (e.g., in embodiments where the interface is presented on a touch screen display). In yet another example, the player may be required to adjust the size of the simulated musical interface 100 (e.g., where the interface is a piano keyboard, the size of the keys). In yet a further example, the player may adjust which "instrument" is associated with the simulated musical interface 100. One or more of these examples and other similar examples may be combined in any way.

As illustrated in FIG. 1 in accordance with one or more embodiments, the simulated musical interface 100 may be presented to a player on a touch screen video button deck, which is operatively coupled to the gaming machine (e.g., wired or wireless). In the embodiment shown, the simulated musical interface 100 is a simulated musical instrument, such as a piano or synthesizer keyboard 101 with a plurality of keys 102. The simulated musical interface 100 may have one or more activatable regions (e.g., different regions on a touch screen display that correlate to each of the keys 102). The activatable regions may alternatively or additionally correspond to other player input devices, such as wagering buttons and the like. For example, the simulated musical interface may be a graphical representation of a keyboard that may be "played" by activating one or more wagering buttons.

The player may be given the option to choose which type of piano to simulate (e.g., vertical or horizontal pianos, such as petite grand, baby grand, parlour grand, and concert grant) or which type of instrument (or noises, such as dog barks at different frequencies for a puppy-themed game) the synthesizer is to simulate. Choosing the type of piano may alter the sound and/or key configuration presented on the musical interface 100. In other embodiments, the simulated musical interface 100 resembles a different instrument, such as a xylophone, flute, clarinet, chimes, or drums. In yet other embodiments, the simulated musical interface 100 may be related to something that is generally not considered instrumental in nature. For example, the simulated musical interface 100 may present a plurality of different types of objects such as garbage cans, garbage can lids, pipes, hub caps, brooms, boxes of matches, and other objects that may be used to generate noise that may be deemed musical when played together.

Figure 2:
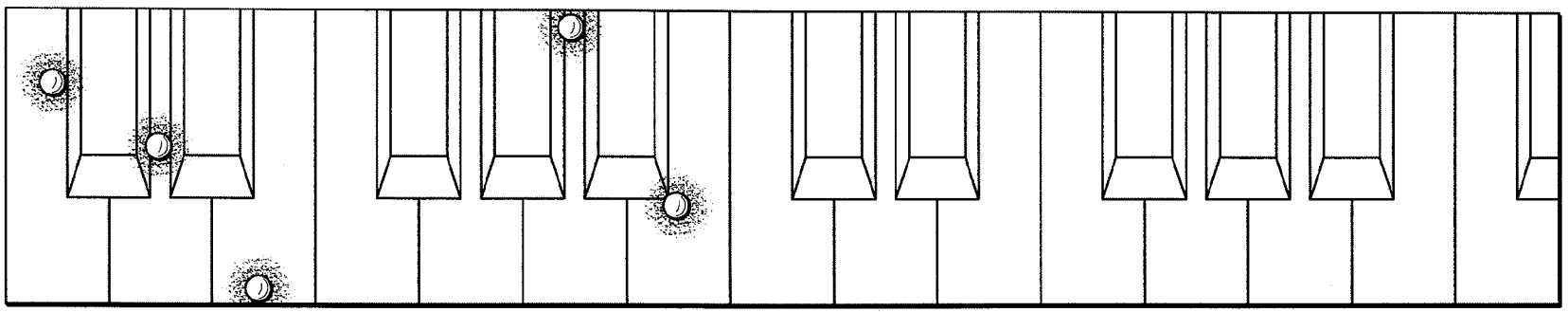
FIG. 2 illustrates one embodiment of a simulated musical interface that presents data indicative of which keys the player is to "play."

As illustrated in FIG. 2, the gaming machine may present data indicative of which keys 102 are to be "played" by the player for the game associated therewith (e.g., primary game, bonus game, tournament game, collaborative game, and the like). In the embodiment shown, dots 104 are presented over the keys 102 to signify which "note" to play and when to play it. Execution of one or more instructions associated with a control program may enable this feature. Dots 104 may be of any color that is easily perceivable when presented on the keys 102. One color may represent the current appropriate one or more keys 102 that the player is to "play," whereas another color may indicate the next one or more keys 102 in sequence that are to be played after the current keys are played. In some embodiments, indicia other than dots may be used. For example, a user-selectable icon or symbol may be used instead of a dot. In other embodiments, the appropriate keys 102 may be highlighted or glow a specific color. For example, "current" keys that need to be "played" may be highlighted green, whereas the next keys 102 in sequence may be highlighted yellow in order to inform the player which notes to prepare to play. In some embodiments, numbers may be used to indicate to the player in which order the keys 102 are to be played.

At the beginning of the game associated with the simulated musical interface 100, the dots 104 (or other indicia) may begin larger or brighter to ease the difficulty of locating the appropriate keys 102. However, as the game progresses, the dots 104 may decrease in size to increase the difficulty of locating the appropriate keys 102 for the player. Additionally, the data indicative of the next keys 102 in sequence may give the player longer notice in the beginning and decrease the amount of notice given to the player as the game progresses to increase the difficulty.

Figure 3:
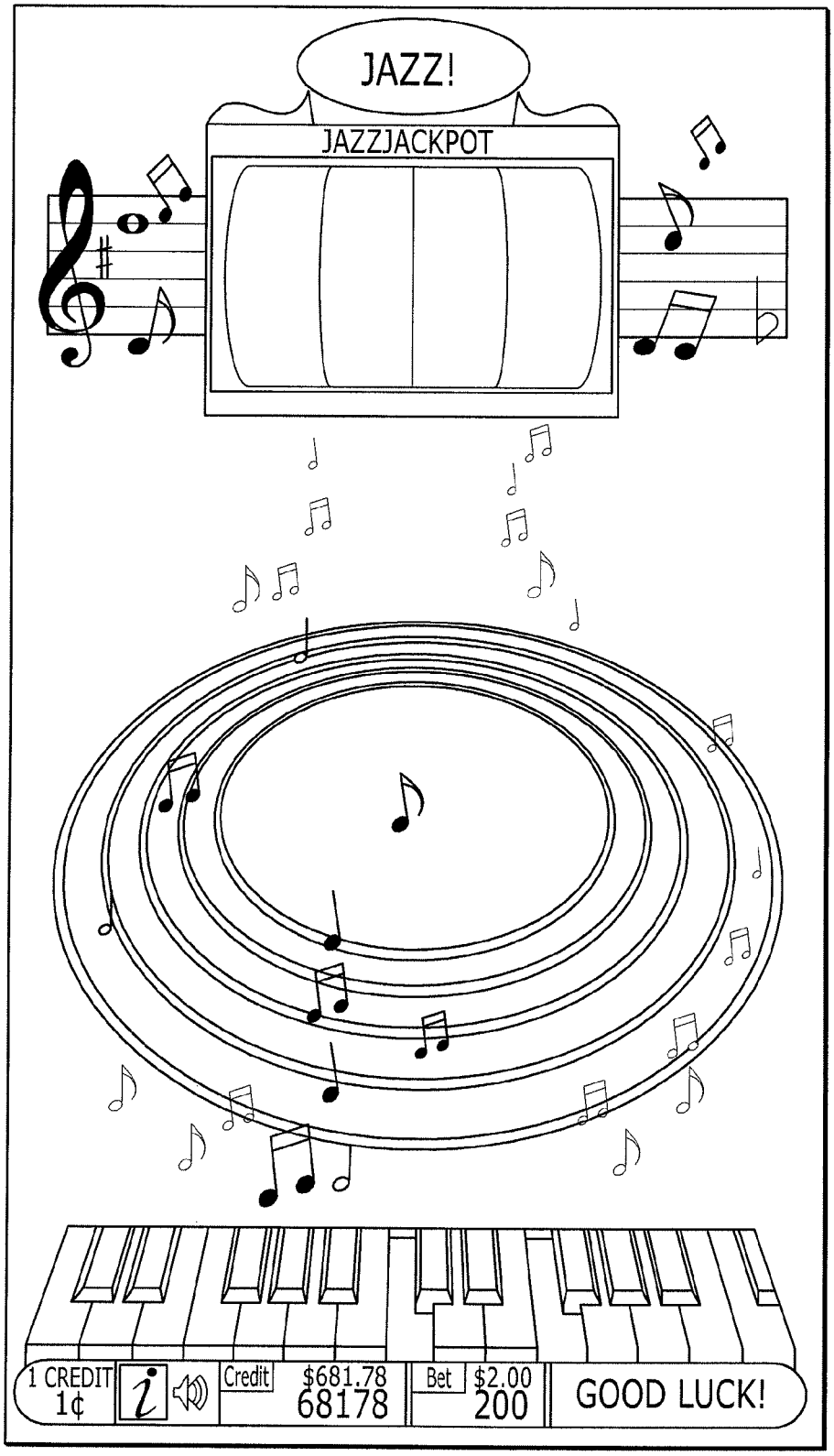
FIG. 3 illustrates one embodiment of a game associated with a musical interface.
Figure 4:
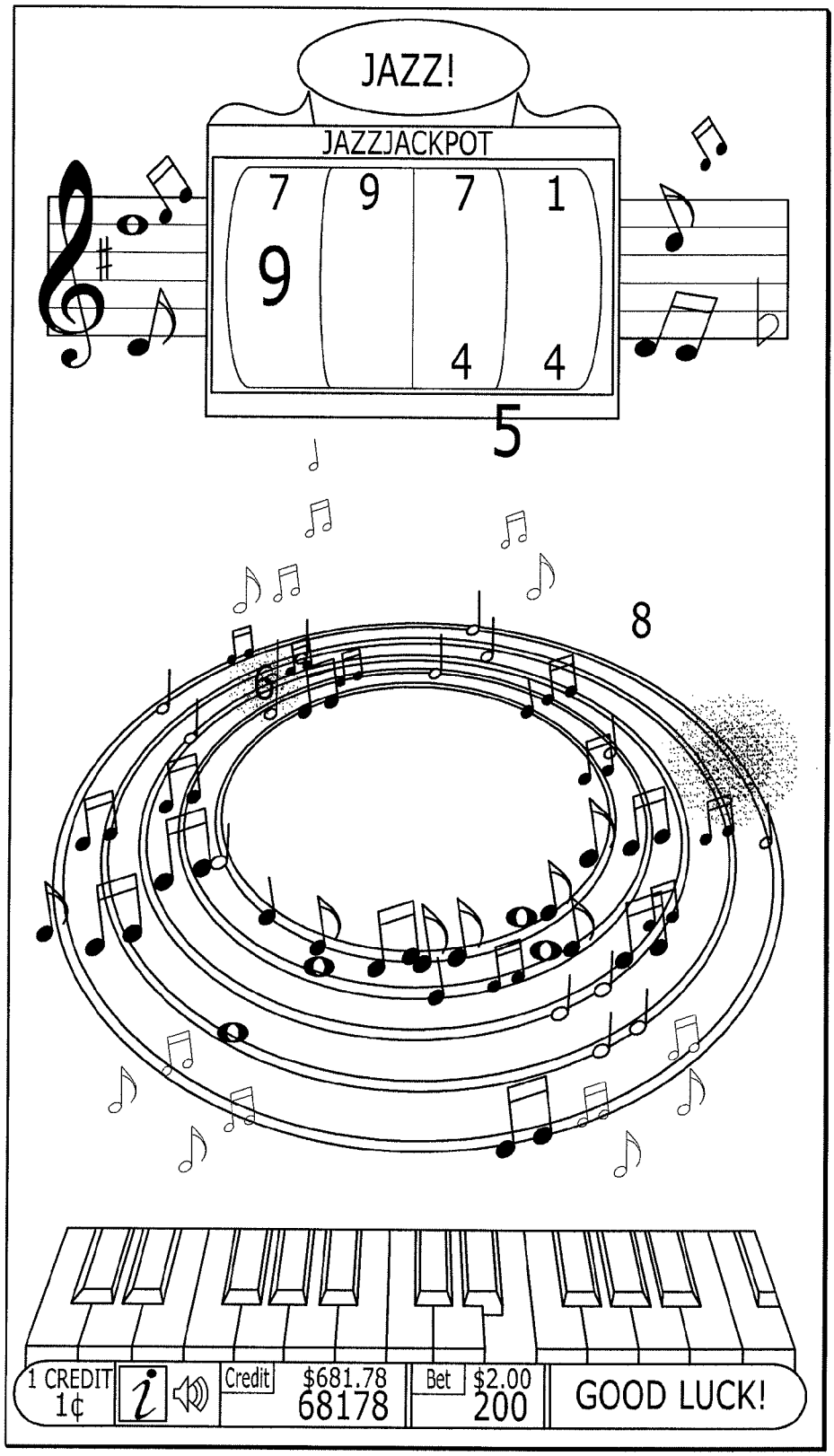
FIG. 4 illustrates the game shown in FIG. 3 during play.

Referring now to FIGS. 3 and 4, an embodiment of a game 300 associated with the musical interface 100 is shown. The game 300 is presented on a display 302 of a gaming machine. The embodiment of game 300 is shown and described as a bonus game. However, the game 300 may not be a bonus game in other embodiments (e.g., a tournament game, a component of a primary game, and the like).

At the beginning of the bonus game 300, one or more bonus reels 304 may be shown to the player without any indicia thereon (e.g., symbols, numbers, and the like). In other embodiments, the one or more bonus reels 304 may begin with one or more predetermined or randomized indicia. In yet other embodiments, the bonus game may present one or more reels, wheels, dice, cards, other representations of objects used to produce random outcomes, or any combination thereof.

To play the bonus game 300, the player may use the simulated musical interface 100, which may be presented on one or more primary game displays, on one or more secondary game displays, a touch screen button deck (e.g., the iDeck™ by Bally Technologies, Inc.), or a combination thereof. As shown in FIGS. 3 and 4, the simulated musical interface 100 may be the piano keyboard 306 having a plurality of keys 308. In such an embodiment, the display 302 may be a touch screen display. Alternatively or additionally, the simulated musical interface 100 may be the piano keyboard 101 presented on a touch screen video button deck depicted in FIGS. 1 and 2 that is operatively coupled to the gaming machine. In some embodiments, the piano keyboard 306 may not be user-interactive. Instead, the piano keyboard 306 may graphically represent one or more actions a player is taking with respect to the simulated musical interface 100 presented on the touch screen video button deck. For example, as the player "plays" the keys 102 on the simulated musical interface 100 presented on the button deck, the corresponding keys 308 on piano keyboard 306 may also be graphically depressed. In this way, a player's friend or companion and even on-lookers may more readily view the player's progress in the bonus game by viewing the display 302 instead of the simulated musical interface 100.

Each time the player plays one or more correct notes, a control program may generate and/or move one or more graphical representations of musical notes 310 on the display 302. The musical notes 310 may or may not affect the one or more outcomes of the bonus game. For example, any indicia presented on the one or more bonus reels 304 may not be dependent on the player's use of the simulated musical interface 100. In this regard, the player may be given the "feel" of affecting the outcome of the bonus game by generating musical notes 310.

The musical notes 310 may be based on the quality and speed of play (e.g., more musical notes may be generated, the size of musical notes may change, the type of the musical notes may change, treble and bass clefs may be generated, and the like). For example, the bonus game 300 may present a song to the player to play. Throughout the song, the player may be given karaoke-like instructions to play one or more notes at certain times. One or more keys 102 on the simulated musical interface 100 may be highlighted, or otherwise indicated, for current play. The bonus game 300 may measure how long it takes for the player to activate the highlighted keys 102 from the moment they are highlighted to being played to measure the speed of the player. Additionally, if the player activates one or more wrong keys 102 (e.g., non-highlighted keys), the bonus game 300 may measure how close the wrongly-activated keys are to the highlighted keys to determine the accuracy of the player. The number, size, and/or type of musical notes 310 (or other symbols or objects generated) may affect the outcome of the bonus game 300.

In some embodiments, a wrongly-played note may not result in a generated musical note 310 (or other symbol or object) or may not result in movement of the corresponding note. In other embodiments, a wrongly-played note may generate or move less musical notes 310 (or other symbol or objects) than compared to the number musical notes 310 (or other symbols or objects) generated for a correctly played note. Similarly, slower play by the player may result in less musical notes 310 than compared to the number of musical notes 310 generated for faster play. In some embodiments, accuracy may be more important than speed. In other embodiments, speed may be more important than accuracy. The quality and speed of play may be associated with levels of play, which may affect the outcome of the bonus game 300. For example, low quality play may result in the player earning a "musician in training" banner or other indicia, whereas high quality play may result in the player earning a "professional musician" banner or other indicia. These banners may, for example, translate to a multiplier that becomes activated when the player begins play of a primary game after the bonus game 300 ends. In other embodiments, these banners may affect an award associated with the bonus game (e.g., by multiplying the award, adding to the award and the like).

Generated musical notes 310 (or other symbols or objects, such as a musical rest symbol) may initially appear near the one or more keys 102 that are associated with the generated musical notes. In other embodiments, the musical notes 310 may move off of a musical staff upon being played. The generated or moved musical notes 310 may travel along a predetermined or randomized path to one or more holding areas 312. In some embodiments, the musical notes 310 (or other symbols or objects), may be generated in the one or more holding areas 312 so that they do not have to travel to one or more of the holding areas 312. In yet other embodiments, musical notes 310 (or other symbols or objects) may be generated on the one or more bonus reels instead of being generated in a holding area 312. These notes, symbols, objects, or numbers may be selected and placed on the one or more reels 304 randomly or by a predefined algorithm.

As shown, holding area 312*a* may be a circular representation of a musical staff. However, in other embodiments, holding area 312*a* may be of a different shape and size configured to represent to the player that musical notes are being held or staged. Additionally, the one or more reels 304 may overlay a musical staff 311 to create one or more holding areas 312*b* and 312*c* on each end of the musical staff 311 that is not covered by the one or more bonus reels 304.

In some embodiments, a first holding area (such as holding area 312*a*) may correspond to correctly played notes, and a second holding area (such as holding areas 312*b* and 312*c*) may correspond to incorrectly played notes. Alternatively or additionally, correctly played notes may be a first color (e.g., black), and incorrectly played notes may be a second color (e.g., red).

Musical notes, symbols, objects, or numbers generated in or moved to or from one or more holding areas 312 may travel to one or more of the bonus reels 304 after a certain amount of time (e.g., 15 seconds, 30 seconds, 1 minute), a certain number of notes are correctly played, a certain number of notes are incorrectly played, or any combination thereof. The musical notes, or some other graphical representation, may travel along a randomized path (e.g., a Bezier curve selected from a plurality of different Bezier curves to provide smooth, non-linear movement) to the one or more bonus reels 304. At this point, the musical simulation component of the bonus game 300 may stop. In some embodiments, the musical simulation may continue if the one or more bonus reels 304 do not contain enough indicia to meet a predefined threshold. For example, this threshold may require that the player play the musical simulation until the one or more bonus reels 304 are 10% filled, 20% filled, 50% filled, and the like. In an embodiment where each bonus reel 304 has 10 available positions for indicia, 50% filled may require that each reel has five out of the ten positions filled with a symbol, object, number, or the like.

In some embodiments, the holding area 312*a* may inform the player which musical notes 310 to play separately from or in conjunction with the data indicative of which keys 102 are to be "played." In such embodiments, a plurality of musical notes 310 may rotate around the holding area 312*a* depicted as a circular staff. Other embodiments utilize a non-circular musical staff. Musical notes 310 to be played may be generated at a starting point, such as the top of the holding area 312*a*. The musical notes 310 may rotate around the musical staff while maintaining their respective positions on the staff so that the player can recognize the note which is to be played based on the position on the musical staff alone. The player, gaming machine, or casino operator may configure the gaming machine so that it does not present any data indicative of which keys 102 are to be "played" to increase the difficulty of the game. Increasing the difficulty in such a way may reward the player by increasing any award won (e.g., multiplier, adder, different pay table, altering a pay table, and the like).

The circular musical staff 312*a* may include one or more zones of play. As the musical notes 310 rotate around the circular staff, they enter these zones. In embodiments employing a horizontal staff, the notes may be generated at the far left and traverse to the right as play progresses to enter these one or more zones of play. In other embodiments, the musical notes traverse from right to left. From the starting point, the musical notes 310 generated for play may rotate (clockwise or counter-clockwise) into a first "active" zone. Following the first "active" zone, the musical notes 310 may continue to rotate around the circular staff to enter into a second "active" zone. Following the second "active" zone, the musical notes 310 may continue moving to enter into a third "active" zone. The one or more "active" zones may be immediately adjacent to one another or be interspersed with or followed by one or more "inactive" zones. Following the third "active" zone, the musical notes 310 may disappear or be moved to a holding area. This holding area may be a single holding area that holds all notes (i.e., correctly played notes, incorrectly played notes, and non-played notes). This holding area may also include notes of varying color (e.g. a first color scheme for correctly played notes, a second color scheme for incorrectly played notes, and a third color scheme for non-played notes). For example, non-played notes may be colored white with or without a pattern. Alternatively, non-played notes may be moved to a holding area designated for "non-played" musical notes, such that a separate holding area may correspond to each type of note.

The speed that the musical notes 310 move around the circular staff may vary. For example, upon being generated, the musical notes 310 may increase in speed as they rotate further around the circular musical staff. In this embodiment, the speed at which the musical notes 310 move through the first zone is slower than the speed that the musical notes 310 move through the second zone, and so forth. In other embodiments, the musical notes 310 may decrease in speed as they rotate further around the circular musical staff. In this embodiment, the speed at which the musical notes 310 move through the first zone is faster than the speed that the musical notes 310 move through the second zone, and so forth. In embodiments employing "inactive" zones, the musical notes 310 may only increase or decrease in speed while within these zones. As the musical notes 310 enter each "active" zone, the musical notes 310 may move at a constant speed. In some embodiments, this constant speed correlates to the speed at which the musical notes 310 entered the "active" zone. In other embodiments, the musical notes 310 may rotate at a constant speed around the musical staff. In yet other embodiments, the speed at which the musical notes 310 move is dependent on the zone. For example, the "inactive" zones may correspond to a first speed, the first "active" zone may correspond to a second speed, the second "active" zone may correspond to a third speed, and the third "active" zone may correspond to a fourth speed. Two or more of the first, second, third, and fourth speeds may be the same. In one embodiment, the second and fourth speeds may be faster than the third speed.

In some embodiments, the musical notes 310 may only be played while the notes are present in one of the "active" zones. However, other embodiments may allow notes to be played in the "active" and "inactive" zones, but the player may incur a penalty for playing a note in an "inactive" zone.

While musical notes are in an "active" zone, data indicative of which keys 102 are to be played on the simulated musical interface 100 that correspond to the one or more musical notes 310 within the zone may be presented to the player. In some embodiments, not all zones present data indicative of which keys 102 are to be played to enhance the difficulty. For example, the first zone may correspond to a "skill," "professional musician," or "luck" zone, such that the player is able to play the musical notes 310 while within that zone without data indicative of which keys 102 are to be played. However, other embodiments still highlight or indicate which keys 102 are to be played, and instead, solely rely on the speed at which the musical notes 310 travel through the first zone for the added difficulty. Successful activation of the appropriate keys 102 while notes are in the first zone may result in an enhanced reward. The enhanced reward may correspond to the individual musical note 310 played. For example, a note played within the first zone that is randomly transformed into the value of 7 for placement on the bonus reel may have an adder (e.g., +1 or +2 and the like) associated with it. This enhanced reward would result in placement of an 8 or 9 (depending on the adder amount) on the bonus reel instead of a 7.

The enhanced reward may alternatively or additionally correspond to the overall award of the game, if any. For example, the enhanced reward may result in adding or multiplying the overall award by a certain static or dynamic amount. In some embodiments, a certain number of musical notes successfully played within the first zone "unlock" the enhanced reward. For example, 1, 2, 5, 10, 20 or more notes may be required to unlock the reward so that it may be applied to the overall award. In other embodiments, each musical note successfully played within the first zone may result in an adder or multiplier amount being successively increased. For example, a certain credit amount may correspond to each note (e.g., 5 credits, 10 credits, 25 credits, 100 credits, and the like). For every note played in the first zone, credits may be added to the overall award, such that 3 notes result in a 75 credit bonus (where 25 credits correspond to each note) and 10 notes result in a 300 credit bonus (where 30 credits correspond to each note). In other embodiments, the value of each successive note may increase. For example, 5 credits may correspond to the first note, 10 credits may correspond to the second note, and 25 credits may correspond to the third note, and so forth. In embodiments employing a multiplier, the number of notes successfully played within the first zone may directly relate to the multiplier. For example, 5 notes may correspond to a ×5 multiplier whereas 12 notes may result in a ×12 multiplier. Alternatively, the multiplier may be configured to rise more slowly. For example, the first note may correspond to a multiplier of ×2 and every successive note played after that within the first zone may result in 0.25, 0.3, 0.4, 0.5, and the like added to the multiplier. In this embodiment, 5 notes may result in a multiplier of ×3 where each successive note after the first adds 0.25.

Referring now to the second zone that follows the first zone, the second zone may correspond to a "normal" or "musician" zone of play where the overall game reward may neither be increased nor decreased based on successful notes played within this zone. Otherwise stated, musical notes may still be generated that may ultimately transform into, for example, a randomized number that is placed onto the bonus reel. However, the notes within this zone may not increase or decrease the outcome of the overall game or the value of the numbers presented on the bonus reel. In some embodiments, however, notes played within the first zone may randomly transform into a number between a range of, for example, 8-10; whereas notes played within the second zone may randomly transform in a number between a range of, for example, 3-7. Continuing, notes played within the third zone may randomly transform into a number between a range of, for example, 0-2. In other embodiments, the notes may transform into symbols or other indicia that correspond to a pay table. Similarly, certain symbols or other indicia may be randomly generated based on the zone the note was successfully played in. Also, in some embodiments, a separate holding area and/or color is associated with the successfully played notes of each zone. In this regard, some embodiments may have holding areas for incorrectly played notes, non-played notes, correctly played notes in the first zone, correctly played notes in the second zone, correctly played notes in the third zone, and correctly played notes in the "inactive" zone.

Referring now to the third zone that follows the first and second zones, the third zone may correspond to a "last chance" or "musician in training" zone. Successful activation of the appropriate keys 102 while notes are in the third zone may result in a decreased reward, but a reward nonetheless. The decreased reward may correspond to the individual musical note 310 played. For example, a note played within the third zone that is randomly transformed into the value of 7 for placement on the bonus reel may have a subtracter (e.g., −1 or −2 and the like) associated with it. This decreased reward would result in placement of a 5 or 6 (depending on the subtracter amount) on the bonus reel instead of a 7.

The decreased reward may alternatively or additionally correspond to the overall award of the game, if any. For example, the decreased reward may result in subtracting or dividing the overall award by a certain static or dynamic amount. In some embodiments, a certain number of musical notes successfully played within the first zone incur such a penalty. For example, 1, 2, 5, 10, 20 or more notes may be required to incur the penalty. In other embodiments, each musical note successfully played within the third zone may result in a subtracter or divider amount being successively increased. For example, a certain credit amount may correspond to each note (e.g., 5 credits, 10 credits, 25 credits, 100 credits, and the like). For every note played in the third zone, credits may be subtracted from the overall award, such that 3 notes result in a 75 credit penalty (where 25 credits correspond to each note) and 10 notes result in a 300 credit penalty (where 30 credits correspond to each note). In other embodiments, the value of each successive note may increase. For example, 5 credits may correspond to the first note, 10 credits may correspond to the second note, and 25 credits may correspond to the third note, and so forth. In embodiments employing a divider (e.g., a multiplier less than 1), the number of notes successfully played within the first zone may directly relate to the multiplier acting as a divider. For example, 10 notes may correspond to a ¼ multiplier whereas 20 notes may result in a ½ multiplier.

Referring now to the "inactive" zones that may be interspersed between the "active" zones or otherwise follow one or more of the "active" zones, successful play of the musical notes 310 within "inactive" zones may result in the player incurring one or more penalties. A penalty may include a negative reward such as a subtracter or divider (e.g., −100 credits, −500 credits, and the like) that decreases the overall award. Each note successfully played in one or more "inactive" zones may individually or in the aggregate be associated with one or more penalties. Alternatively or additionally, a correctly played note from an "active" zone may be removed from its corresponding holding area (e.g., disappear) for each successfully played note in an "inactive" zone. Instead of a 1:1 note removal ratio, other embodiments may employ ratios such as 1:2, 1:3, 1:4, 2:1, 3:1, 4:1 and the like. Non-played notes may similarly be associated with a penalty and/or correctly played note removal.

In some embodiments, musical notes played that are played within each "active" zone result in an enhanced reward, such as an adder, multiplier, increased game play length, and the like. In other embodiments, musical notes played in one zone cannot be played in another zone because they move off of the circular musical staff to a holding area.

In some embodiments, successfully playing the notes in the "active" or "inactive" zones may not affect any reward. Rather, they may merely be used to keep track of the player's progress for purposes such as keeping a record for the player that is published on a website, qualifying for a tournament, and the like. Embodiments employing enhanced, normal, and decreased rewards may also keep score of the player's progress in this fashion to further enhance game play.

As shown in FIG. 4, the musical notes 310 may be transformed into a random numerical representation 314 of a value from zero to nine. In some embodiments, larger numbers are placed on the reels further left to ensure a greater award. This may occur, for example, when the player triggered the bonus game 300 after making the maximum bet. In other embodiments, smaller numbers are placed on the reels further left to ensure a lesser award. This may occur, for example, when the player triggered the bonus game 300 after making the minimum bet. In yet other embodiments, the numbers are placed on the reels in a completely randomized manner and may not even be based on the player's play of the bonus game.

Once the one or more bonus reels 304 are ready to be spun (e.g., all available positions on the reels are filled), the player or the gaming machine initiates the spin of the one or more bonus reels 304 to generate a random outcome. The value shown across the center of the one or more bonus reels 304 may be the amount of credits awarded to the player. In some embodiments, more than one pay line may be associated with the one or more bonus reels 304. Activation of more than one pay line in the bonus game 300 may be dependent on the number of pay lines and/or the amount bet per line in the primary or base game. In these embodiments, each pay line associated with the one or more bonus reels 304 may provide an award to the player. Alternatively, the player may only receive the best award amongst the plurality or the player may be able to choose which award to receive.

Other embodiments may include different numerical representations or non-numerical representations. For example, the one or more bonus reels 304 may present a plurality of symbols that correspond to one or more different, winning outcomes. In such embodiments, rather than transform the musical notes 310 (or other symbols or objects) into random numerical representations, the musical notes 310 themselves may be positioned on the one or more reels 304. A pay table may associate a plurality of different combinations of a plurality of different notes to different awards. For example, four whole notes in a row (i.e., corresponding to a pay line) may correspond to a first award whereas four eighth notes in a row may correspond to a second award. The pay table may associate different sizes of notes as multipliers, additional credit awards, and the like. For example, three normally-sized whole notes and one large whole note in a row may result in the first award multiplied by two. Two normally-sized whole notes and two large whole notes in a row may result in the first award multiplied by four. In addition, three normally sized whole notes and one small whole note may result in the first award being multiplied by one-half. In this way, musical note sizes may directly affect the one or more outcomes of the bonus game 300. Different symbols may act as wild notes. For example, a bass clef or treble clef may be coveted because it may act as a wild symbol or convert the entire reel into a wild reel.

In embodiments employing a first holding area for correctly played notes and a second holding area for incorrectly played notes, the indicia on the one or more bonus reels 304 may be affected by one or both types of notes. For example, the correctly played notes may be presented on or transformed into numerical representations on the one or more reels 304 while the incorrectly played notes may remain in the holding area. The one or more reels 304 may be spun to generate a first outcome corresponding to the correctly played notes. Next, the one or more bonus reels 304 may be emptied of the indicia. Alternatively, a second set of one or more reels may complement the one or more reels 304 (or the second set of reels for incorrectly played notes). Incorrectly played notes may then be presented on or transformed into numerical representations on the one or more reels 304. The one or more reels 304 may be spun to generate a second outcome corresponding to the incorrectly played notes. In some embodiments, the second outcome is subtracted from the first outcome to penalize the player for playing incorrect notes. If the first award falls below zero or some other amount (e.g., 100 credits, 500 credits, and the like), the player may receive a consolation award. In other embodiments, the second outcome may be added to the first outcome so as not to penalize the player.

Additionally, the bonus game 300 may first compare the number of correctly played notes against the number of incorrectly played notes. If the number of incorrectly played notes exceeds the number of correctly played notes, the bonus game 300 may end without spinning the one or more reels 304 to generate an outcome. Alternatively, the bonus game 300 may remove a correctly played note from the holding area for every incorrectly played note in each respective holding area. Instead of a 1:1 note removal ratio, other embodiments may employ ratios such as 1:2, 1:3, 1:4, 2:1, 3:1, 4:1 and the like. For example, the bonus game 300 may remove a correctly played note for every two incorrectly played notes or remove two correctly played notes for every one incorrectly played note. After the correctly played notes have been appropriately decreased (or increased because there were no incorrectly played notes), the bonus game 300 may then be presented on or transformed into numerical representations on the one or more reels 304.

In some embodiments, the bonus game 300 may ultimately award a player based on a poker hand dealt from a deck of cards instead of the one or more reels 304. In these embodiments, the deck of cards may initially start with zero cards or a predetermined number of cards. Correctly played notes may generate or be transformed into one or more cards that are placed in the deck. Incorrectly played notes may remove one or more cards from the deck or remove one or more correctly played notes from a holding area. The cards may correspond to a typical 52-card deck nomenclature (e.g., aces, jacks, kings, and the like) but may or may not be limited to four of each kind of card and thirteen of each suit. For example, six musical notes may be transformed into "fives" and nine musical notes may be transformed into "eights." Additionally, a card may only be associated with a value from zero to nine in some embodiments.

Once the deck is complete, the player or the gaming machine may initiate the dealing of the deck. The deck may be deemed complete after a predefined number of cards have been generated, after a certain amount of time has elapsed, after a certain number of correctly played notes or incorrectly played notes have been played, and the like. Depending on the embodiment, one, two, three, four, five, six, seven, or more cards may be dealt from left-to-right, right-to-left, or randomly for the player.

The player's award may be based on an actual poker hand achieved where the cards represent a 52-card deck nomenclature, such as two of a kind, three of a kind, two pair, a straight, and the like. In embodiments where each card simply has a numerical value from zero to nine, the player's award may be based on the value of the hand, read from left-to-right or right-to-left. For example, a three card hand dealt that reads from left-to-right as [3] [6] [2] may result in the player receiving 362 credits. One of the cards may be selected as a multiplier or the gaming machine may randomly select one of the cards or deal a new card that operates as a multiplier. For example, 32 credits may be multiplied by 6 if the [6] is selected as the multiplier, whereas 62 credits may be multiplied by 3 if the [3] is selected as the multiplier.

Those of ordinary skill in the art will appreciate that one or more circuits and/or software may be used to implement the methods and processes described herein. Circuit refers to any circuit, whether integrated or external to a processing unit. Software refers to code or instructions executable by a processing unit to achieve the desired result. This software may be stored locally on a processing unit or stored remotely and accessed over a communication network.

In accordance with one or more embodiments, progressive prizes may be awarded as part of game play. In one or more embodiments, extruded geometric patterns overlaying one or more trigger symbols may award one or more progressive prizes. The progressive prizes may be calculated by a progressive controller such as a controller manufactured by Mikohn, Inc. The progressive controller monitors wagering during base game play, calculates a current value for one or more progressive jackpot pools and transmits the current pool values to the gaming machine. In one or more embodiments, progressive awards are accumulated during regular play as a percentage, such as three percent, of the game play take. The prizes may be sized according to the preferences of the casino operator. The number of prizes may also vary. The size of the prizes is dependent on the amount of play prior to initiating feature play and may come from the contributions of a single gaming machine or a number of linked gaming machines. In another aspect, the prizes may be set amounts established by the casino operator from non-coin-in funds, such as marketing funds.

In one or more embodiments, the prizes for feature game play may be accumulated based on funding mechanisms other than a percentage of wagers accumulated by the gaming machine. For example, an operator may initially fund various award pools with a pre-determined amount of money, such as $1000 for one progressive, $500 for a second progressive, $100 for a third progressive and so on. Subsequently, the casino operator may determine to increase the amounts of one or more of the awards at pre-determined times which may be periodically or randomly selected with a range of times or periods. Once a winner has occurred at any level, the award levels may be rolled back to the initial funding level. In one or more embodiments, only the winning award level is rolled back to the initial funding level.

In one or more embodiments, the prizes for feature game play may be set amounts, i.e., non-progressive. In one or more embodiments, the algorithms to determine the amounts may be determined by a statistical percentage based on an average take of a gaming machine and the likelihood of the win over a period of time. In the case where one or more gaming machines are networked, a common award table may be utilized where the award algorithms are determined based on an average take (total wagers) of all the networked gaming machines and the likelihood of a win of an award over a period of time. Each award may be calculated in a similar manner based on the likelihood of a winning outcome being achieved during a game play session.

Figure 5:
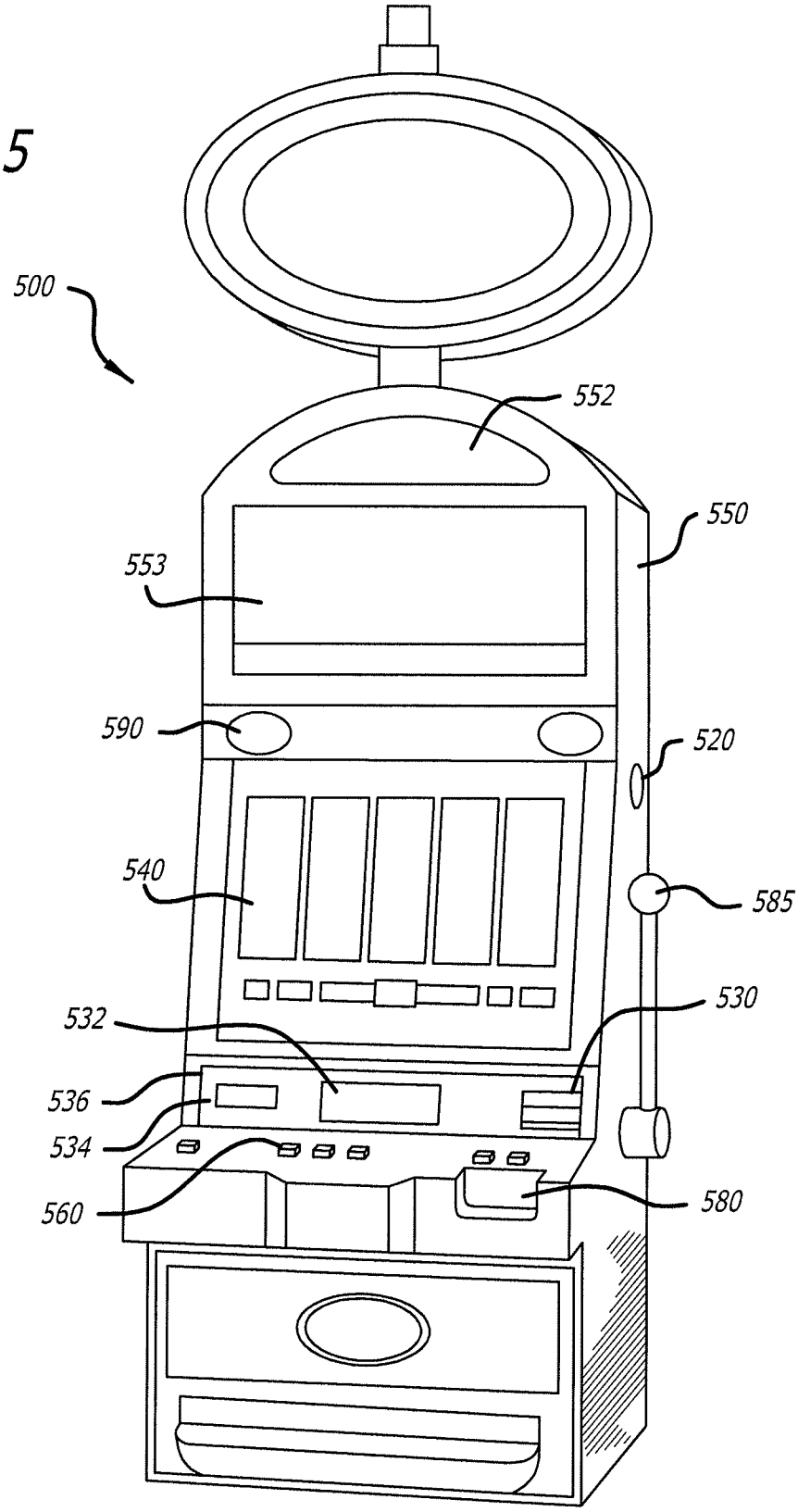
FIG. 5 is a perspective view of a gaming machine in accordance with one or more embodiments.

Referring to FIG. 5, gaming machine 500 capable of supporting various embodiments is shown, including cabinet housing 520, primary game display 540 upon which a primary game and feature game may be displayed, top box 550 which may display multiple progressives that may be won during play of the feature game, player-activated buttons 560, player tracking panel 536, bill/voucher acceptor 580 and one or more speakers 590. Cabinet housing 520 may be a self-standing unit that is generally rectangular in shape and may be manufactured with reinforced steel or other rigid materials which are resistant to tampering and vandalism. Cabinet housing 520 may alternatively be a handheld device including the gaming functionality as discussed herein and including various devices of the described components herein. For example, a handheld device may be a cell phone, personal data assistant, or laptop or tablet computer, each of which may include a display, a processor, and memory sufficient to support either stand-alone capability such as gaming machine 400 or thin client capability such as that incorporating some of the capability of a remote server.

In one or more embodiments, cabinet housing 520 houses a processor, circuitry, and software (not shown) for receiving signals from the player-activated buttons 560, operating the games, and transmitting signals to the respective displays and speakers. Any shaped cabinet may be implemented with any embodiment of gaming machine 500 so long as it provides access to a player for playing a game. For example, cabinet 520 may comprise a slant-top, bar-top, or table-top style cabinet, including a Bally Cinevision™ or CineReels™ cabinet. The operation of gaming machine 500 is described more fully below.

The plurality of player-activated buttons 560 may be used for various functions such as, but not limited to, selecting a wager denomination, selecting a game to be played, selecting a wager amount per game, initiating a game, or cashing out money from gaming machine 400. Buttons 460 may be operable as input mechanisms and may include mechanical buttons, electromechanical buttons or touch screen buttons. Optionally, a handle 585 may be rotated by a player to initiate a game.

In one or more embodiments, buttons 560 may be replaced with various other input mechanisms known in the art such as, but not limited to, a touch screen system, touch pad, track ball, mouse, switches, toggle switches, or other input means used to accept player input such as a Bally iDeck™. One other example input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 520 may optionally include top box 550 which contains "top glass" 552 comprising advertising or payout information related to the game or games available on gaming machine 500. Player tracking panel 536 includes player tracking card reader 534 and player tracking display 532. Voucher printer 530 may be integrated into player tracking panel 536 or installed elsewhere in cabinet housing 520 or top box 550.

Game display 540 may present a game of chance wherein a player receives one or more outcomes from a set of potential outcomes. For example, one such game of chance is a video slot machine game. The gaming machine 500 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 540 is, typically, a CRT or a flat-panel display in the form of, but not limited to, liquid crystal, plasma, electroluminescent, vacuum fluorescent, field emission, or any other type of panel display known or developed in the art. Game display 540 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 440 preferably includes a touch screen or touch glass system (not shown) and presents player interfaces such as, but not limited to, a credit meter (not shown), a win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference in its entirety for all purposes.

Game display 540 may also present information such as, but not limited to, player information, advertisements and casino promotions, graphic displays, news and sports updates, or may even offer an alternate game. This information may be generated through a host computer networked with gaming machine 500 on its own initiative or it may be obtained by request of the player using either one or more of the plurality of player-activated buttons 560; the game display itself, if game display 540 comprises a touch screen or similar technology; buttons (not shown) mounted about game display 540 which may permit selections such as those found on an ATM machine, where legends on the screen are associated with respective selecting buttons; or any player input device that offers the required functionality.

Cabinet housing 520 incorporates a single game display 540. However, in alternate embodiments, cabinet housing 520 or top box 550 may house one or more additional displays 553 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

Figure 6A:
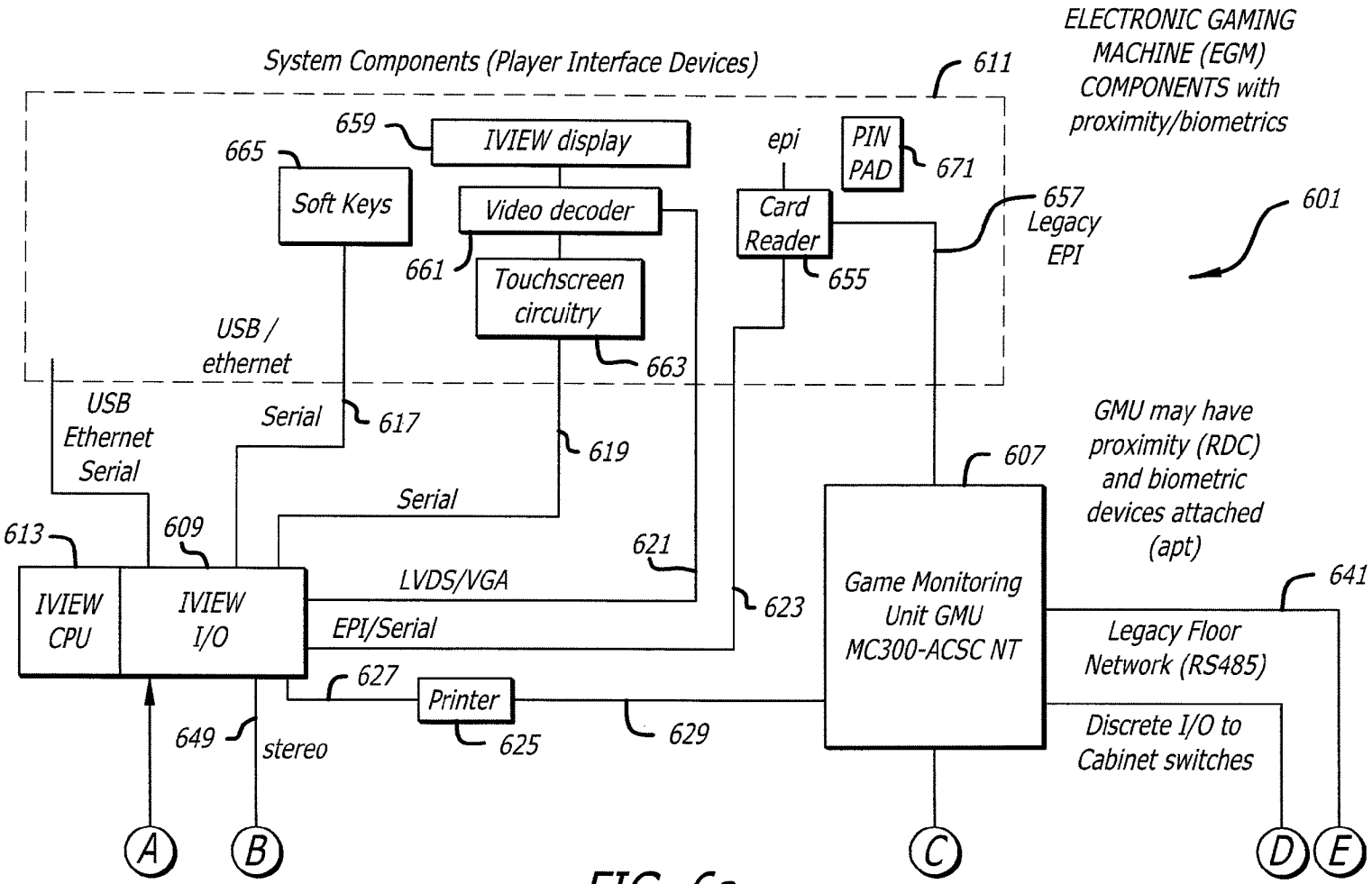
FIG. 6*a* is a block diagram of the physical and logical components of the gaming machine of FIG. 5 in accordance with one or more embodiments.
Figure 6B:
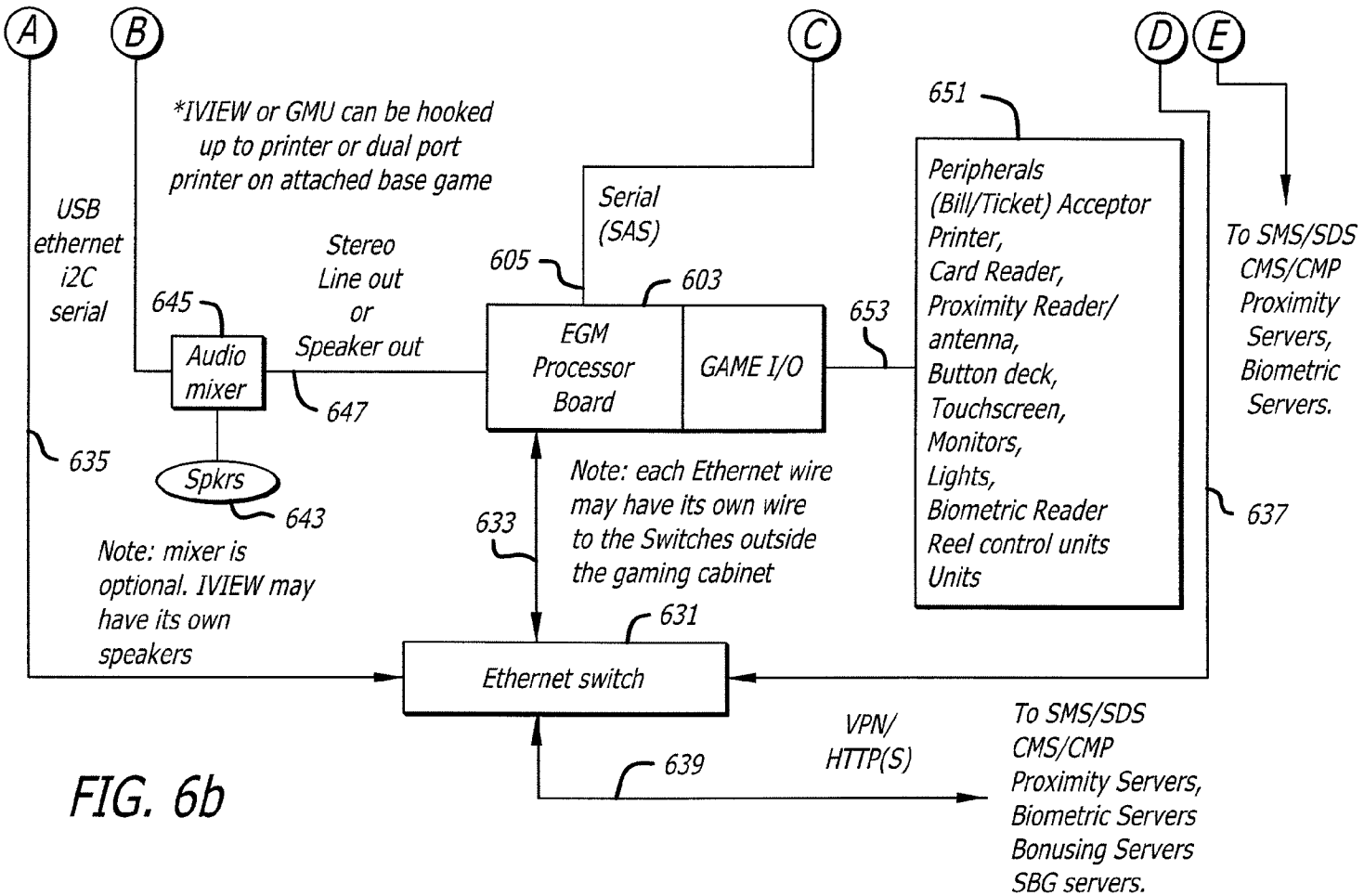
FIG. 6*b* is a continuation of the block diagram shown in FIG. 6*a*.

Referring to FIGS. 6*a* and 6*b*, electronic gaming machine 601 is shown in accordance with one or more embodiments. Electronic gaming machine 601 includes base game integrated circuit board 603 (EGM Processor Board) connected through serial bus line 605 to game monitoring unit (GMU) 607 (such as a Bally MC300 or ACSC NT), and player interface integrated circuit board (PIB) 609 connected to player interface devices 611 over bus lines 613, 615, 617, 619, 621, 623. Printer 625 is connected to PIB 609 and GMU 607 over bus lines 627, 629. Base game integrated circuit board 603, PIB 609, and GMU 607 connect to Ethernet switch 631 over bus lines 633, 635, 637. Ethernet switch 631 connects to a slot management system (SMS) and a casino management system (CMS) network over bus line 639. GMU 607 also may connect to the SMS and CMS network over bus line 641. Speakers 643 connect through audio mixer 645 and bus lines 647, 649 to base game integrated circuit board 603 and PIB 609. The proximity and biometric devices and circuitry may be installed by upgrading a commercially available PIB 609, such as a Bally iView unit. Coding executed on base game integrated circuit board 603, PIB 609, and/or GMU 607 may be upgraded to integrate a game having adjustable multi-part indicia as is more fully described herein.

Peripherals 651 connect through i/o board 653 to base game integrated circuit board 603. For example, a bill/ticket acceptor is typically connected to a game input-output board 653 which is, in turn, connected to a conventional central processing unit ("CPU") base game integrated circuit board 603, such as an Intel Pentium microprocessor mounted on a gaming motherboard. I/O board 653 may be connected to base game integrated circuit board 603 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. Base game integrated circuit board 603 executes a game program that causes base game integrated circuit board 603 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 653 to base game integrated circuit board 603 which, in turn, assigns an appropriate number of credits for play in accordance with the game program. The player may further control the operation of the gaming machine by way of other peripherals 651, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 600; for example, it may be part of a central determination host system which provides random game outcomes to the game program. Thereafter, the player may or may not interact with the game through electromechanical or touch screen buttons to change the displayed indicia. Finally, base game integrated circuit board 603 under control of the game program and OS compares the final display of indicia to a pay table. The set of possible game outcomes may include a subset of outcomes related to the triggering of a feature game. In the event the displayed outcome is a member of this subset, base game integrated circuit board 603, under control of the game program and by way of I/O Board 653, may cause feature game play to be presented on a feature display.

Predetermined payout amounts for certain outcomes, including feature game outcomes, are stored as part of the game program. Such payout amounts are, in response to instructions from base game integrated circuit board 603, provided to the player in the form of coins, credits or currency via I/O board 653 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 607 includes an integrated circuit board and GMU processor and memory including coding for network communications, such as the G2S (game-to-system) protocol from the Gaming Standards Association, Las Vegas, Nev., used for system communications over the network. As shown, GMU 607 may connect to card reader 655 through bus 657 and may thereby obtain player card information and transmit the information over the network through bus 641. Gaming activity information may be transferred by the base game integrated circuit board 603 to GMU 607 where the information may be translated into a network protocol, such as S2S, for transmission to a server, such as a player tracking server, where information about a player's playing activity may be stored in a designated server database.

PIB 609 includes an integrated circuit board, PID processor, and memory which includes an operating system, such as Windows CE, a player interface program which may be executable by the PID processor together with various input/output (I/O) drivers for respective devices which connect to PIB 609, such as player interface devices 511, and which may further include various games or game components playable on PIB 609 or playable on a connected network server and PIB 609 is operable as the player interface. PIB 609 connects to card reader 655 through bus 623, display 659 through video decoder 661 and bus 621, such as an LVDS or VGA bus.

As part of its programming, the PID processor executes coding to drive display 659 and provide messages and information to a player. Touch screen circuitry interactively connects display 659 and video decoder 661 to PIB 609; such that a player may input information and cause the information to be transmitted to PIB 609 either on the player's initiative or responsive to a query by PIB 609. Additionally soft keys 665 connect through bus 617 to PIB 609 and operate together with display 659 to provide information or queries to a player and receive responses or queries from the player. PIB 609, in turn, communicates over the CMS/SMS network through Ethernet switch 631 and busses 635, 639 and with respective servers, such as a player tracking server.

Player interface devices 611 are linked into the virtual private network of the system components in gaming machine 601. The system components include the iVIEW processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to installation on the system components.

The system components include the iVIEW processing board and game monitoring unit (GMU) processing board. The GMU and iVIEW can be combined into one like the commercially available Bally GTM iVIEW device. This device may have a video mixing technology to mix the EGM processor's video signals with the iVIEW display onto the top box monitor or any monitor on the gaming device.

Figure 7:
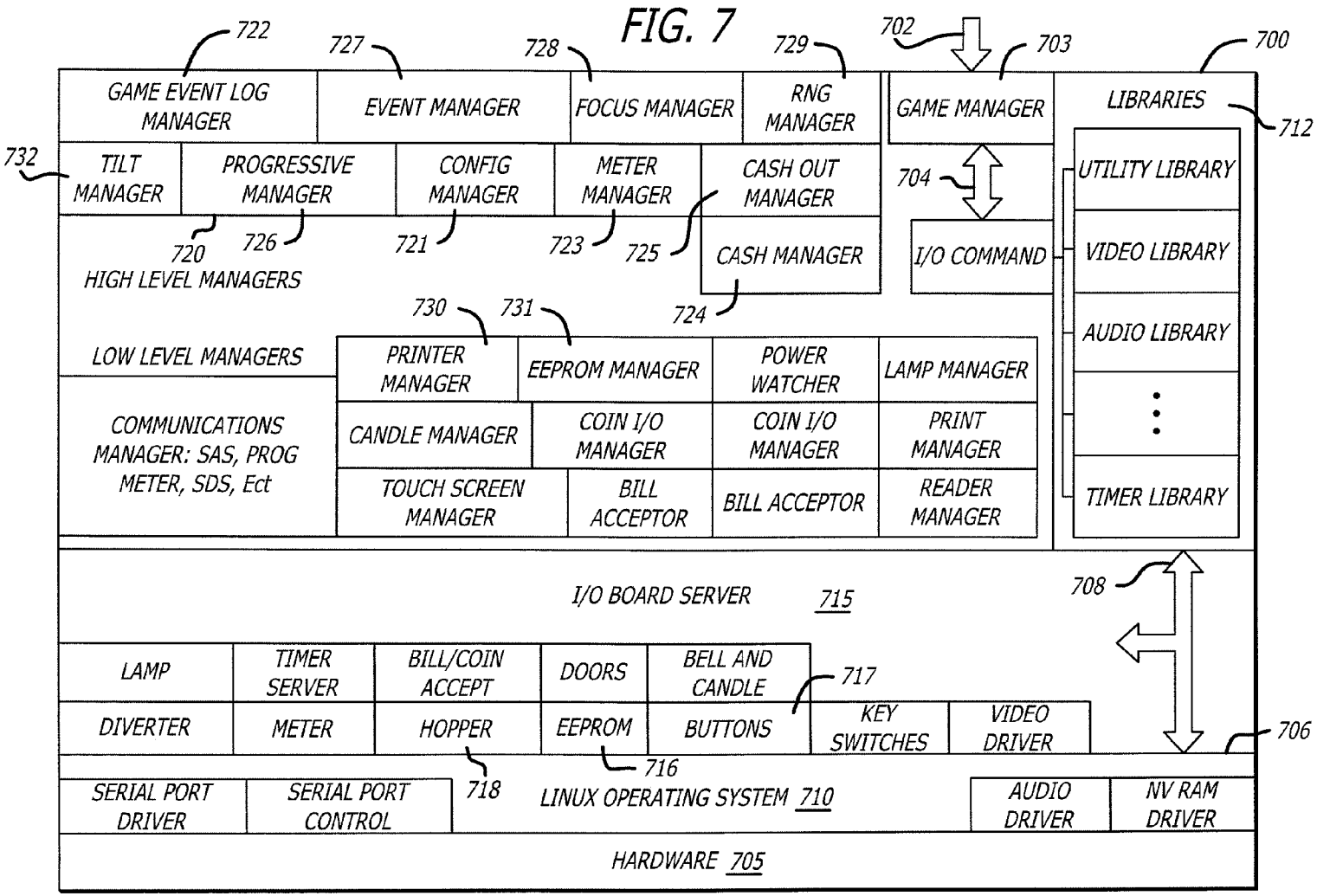
FIG. 7 is a block diagram of the logical components of a gaming kernel in accordance with one or more embodiments.

In accordance with one or more embodiments, FIG. 7 is a functional block diagram of a gaming kernel 700 of a game program under control of base game integrated circuit board 603. The game program uses gaming kernel 700 by calling into application programming interface (API) 702, which is part of game manager 703. The components of game kernel 700 as shown in FIG. 7 are only illustrative and should not be considered limiting. For example, the number of managers may be changed, additional managers may be added or some managers may be removed.

As shown in the example, there are three layers: a hardware layer 705; an operating system layer 710, such as, but not limited to, Linux; and a game kernel layer 700 having game manager 703 therein. In one or more embodiments, the use of a standard operating system 710, such a UNIX-based or a Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 700 executes at the user level of the operating system 710, and itself contains a major component called the I/O Board Server 715. To properly set the bounds of game application software (making integrity checking easier), all game applications interact with gaming kernel 700 using a single API 702 in game manager 703. This enables game applications to make use of a well-defined, consistent interface, as well as making access points to gaming kernel 700 controlled, where overall access is controlled using separate processes.

For example, game manager 703 parses an incoming command stream and, when a command dealing with I/O comes in (arrow 704), the command is sent to an applicable library routine 712. Library routine 712 decides what it needs from a device, and sends commands to I/O Board Server 715 (see arrow 708). A few specific drivers remain in operating system 710's kernel, shown as those below line 706. These are built-in, primitive, or privileged drivers that are (i) general (ii) kept to a minimum and (iii) are easier to leave than extract. In such cases, the low-level communications is handled within operating system 710 and the contents passed to library routines 712.

Thus, in a few cases, library routines may interact with drivers inside operating system 710, which is why arrow 708 is shown as having three directions (between library utilities 712 and I/O Board Server 715, or between library utilities 712 and certain drivers in operating system 710). No matter which path is taken, the logic needed to work with each device is coded into modules in the user layer of the diagram. Operating system 710 is kept as simple, stripped down, and common across as many hardware platforms as possible. The library utilities and user-level drivers change as dictated by the game cabinet or game machine in which it will run. Thus, each game cabinet or game machine may have a base game integrated circuit board 603 connected to a unique, relatively dumb, and as inexpensive as possible I/O adapter board 640, plus a gaming kernel 700 which will have the game-machine-unique library routines and I/O Board Server 715 components needed to enable game applications to interact with the gaming machine cabinet. Note that these differences are invisible to the game application software with the exception of certain functional differences (i.e., if a gaming cabinet has stereo sound, the game application will be able make use of API 702 to use the capability over that of a cabinet having traditional monaural sound).

Game manager 703 provides an interface into game kernel 700, providing consistent, predictable, and backwards compatible calling methods, syntax, and capabilities by way of game application API 702. This enables the game developer to be free of dealing directly with the hardware, including the freedom to not have to deal with low-level drivers as well as the freedom to not have to program lower level managers 730, although lower level managers 630 may be accessible through game manager 703's interface 702 if a programmer has the need. In addition to the freedom derived from not having to deal with the hardware level drivers and the freedom of having consistent, callable, object-oriented interfaces to software managers of those components (drivers), game manager 703 provides access to a set of upper level managers 720 also having the advantages of consistent callable, object-oriented interfaces, and further providing the types and kinds of base functionality required in casino-type games. Game manager 703, providing all the advantages of its consistent and richly functional interface 702 as supported by the rest of game kernel 700, thus provides a game developer with a multitude of advantages.

Game manager 703 may have several objects within itself, including an initialization object (not shown). The initialization object performs the initialization of the entire game machine, including other objects, after game manager 703 has started its internal objects and servers in appropriate order. In order to carry out this function, the kernel's configuration manager 721 is among the first object to be started; configuration manager 721 has data needed to initialize and correctly configure other objects or servers.

The upper level managers 720 of game kernel 700 may include game event log manager 722 which provides, at the least, a logging or logger base class, enabling other logging objects to be derived from this base object. The logger object is a generic logger; that is, it is not aware of the contents of logged messages and events. The log manager's (722) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 723 manages the various meters embodied in the game kernel 700. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 723 receives its initialization data for the meters, during startup, from configuration manager 721. While running, the cash in (724) and cash out (725) managers call the meter manager's (723) update functions to update the meters. Meter manager 723 will, on occasion, create backup copies of the soft meters by storing the soft meters' readings in EEPROM. This is accomplished by calling and using EEPROM manager 731.

In accordance with still other embodiments, progressive manager 726 manages progressive games playable from the game machine. Event manager 727 is generic, like log manager 722, and is used to manage various gaming machine events. Focus manager 628 correlates which process has control of various focus items. Tilt manager 732 is an object that receives a list of errors (if any) from configuration manager 721 at initialization, and during game play from processes, managers, drivers, and the like. that may generate errors. Random number generator manager 729 is provided to allow easy programming access to a random number generator (RNG), as a RNG is required in virtually all casino-style (gambling) games. RNG manager 729 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 725 has the responsibility of configuring and managing monetary output devices. During initialization, cash out manager 725, using data from configuration manager 721, sets the cash out devices correctly and selects any selectable cash out denominations. During play, a game application may post a cash out event through the event manager 727 (the same way all events are handled), and using a callback posted by cash out manager 725, cash out manager 725 is informed of the event. Cash out manager 725 updates the credit object, updates its state in non-volatile memory, and sends an appropriate control message to the device manager that corresponds to the dispensing device. As the device dispenses dispensable media, there will typically be event messages being sent back and forth between the device and cash out manager 725 until the dispensing finishes, after which cash out manager 725, having updated the credit manager and any other game state (such as some associated with meter manager 723) that needs to be updated for this set of actions, sends a cash out completion event to event manager 727 and to the game application thereby. Cash in manager 624 functions similarly to cash out manager 725, only controlling, interfacing with, and taking care of actions associated with cashing in events, cash in devices, and associated meters and crediting.

In a further example, in accordance with one or more embodiments, I/O server 715 may write data to the gaming machine EEPROM memory, which is located in the gaming machine cabinet and holds meter storage that must be kept even in the event of power failure. Game manager 703 calls the I/O library functions to write data to the EEPROM. The I/O server 715 receives the request and starts a low priority EEPROM thread 716 within I/O server 715 to write the data. This thread uses a sequence of 8 bit command and data writes to the EEPROM device to write the appropriate data in the proper location within the device. Any errors detected will be sent as IPC messages to game manager 703. All of this processing is asynchronous.

In accordance with one embodiment, button module 717 within I/O server 715, polls (or is sent) the state of buttons every 2 ms. These inputs are debounced by keeping a history of input samples. Certain sequences of samples are required to detect a button was pressed, in which case the I/O server 715 sends an inter-process communication event to game manager 703 that a button was pressed or released. In some embodiments, the gaming machine may have intelligent distributed I/O which debounces the buttons, in which case button module 717 may be able to communicate with the remote intelligent button processor to get the button events and simply relay them to game manager 703 via IPC messages. In still another embodiment, the I/O library may be used for pay out requests from the game application. For example, hopper module 718 must start the hopper motor, constantly monitor the coin sensing lines of the hopper, debounce them, and send an IPC message to the game manager 703 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 8A:
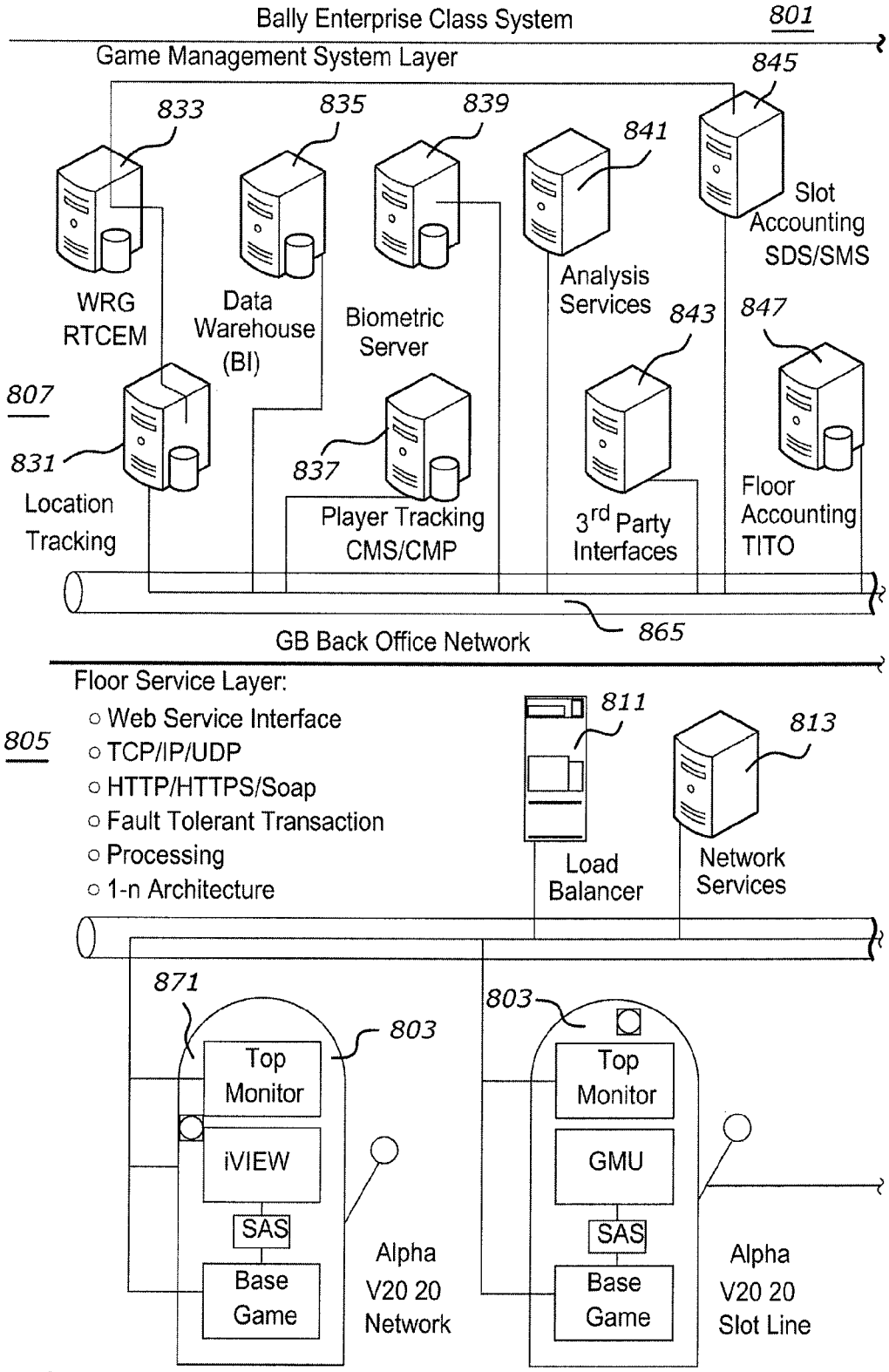
FIG. 8*a* is a schematic block diagram showing the hardware elements of a networked gaming system in accordance with one or more embodiments.
Figure 8B:
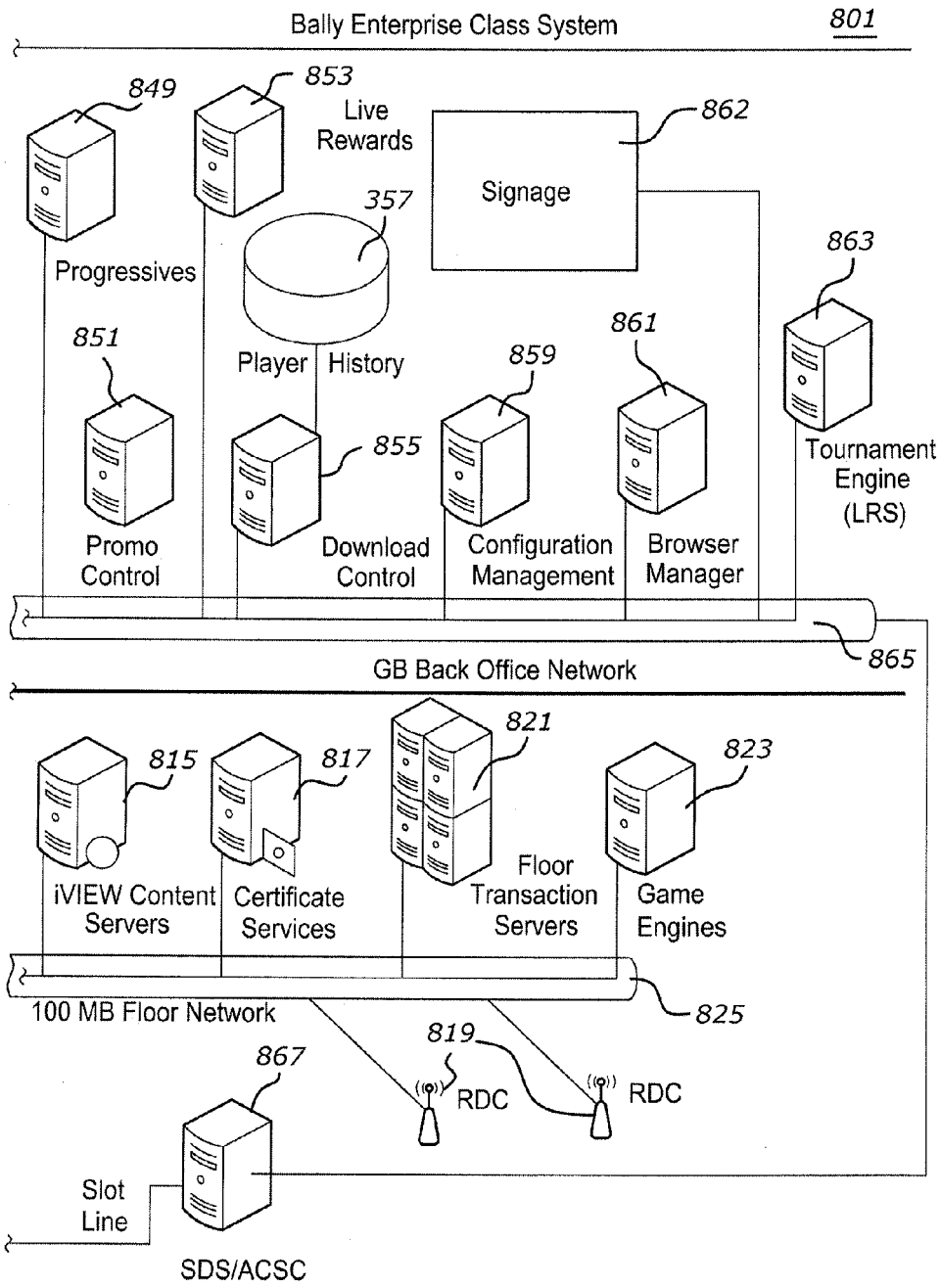
FIG. 8*b* is a continuation of the schematic block diagram shown in FIG. 8*a*.

Referring to FIGS. 8*a* and 8*b*, enterprise gaming system 801 is shown in accordance with one or more embodiments. Enterprise gaming system 801 may include one casino or multiple locations and generally includes a network of gaming machines 803, floor management system (SMS) 805, and casino management system (CMS) 807. SMS 805 may include load balancer 811, network services servers 813, player interface (iVIEW) content servers 815, certificate services server 817, floor radio dispatch receiver/transmitters (RDC) 819, floor transaction servers 821 and game engines 823, each of which may connect over network bus 825 to gaming machines 803. CMS 807 may include location tracking server 831, WRG RTCEM server 833, data warehouse server 835, player tracking server 837, biometric server 839, analysis services server 841, third party interface server 843, slot accounting server 845, floor accounting server 847, progressives server 849, promo control server 851, feature game (such as Bally Live Rewards) server 853, download control server 855, player history database 857, configuration management server 859, browser manager 861, tournament engine server 863 connecting through bus 865 to server host 867 and gaming machines 803. The various servers and gaming machines 803 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming machines 803. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon, and the nature of databases maintained and utilized in performing their respective functions.

Gaming machines 803 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 807 and/or SMS 805 servers and devices, firmware, media, operating systems, and configurations may be downloaded to the system components of respective gaming machines for upgrading or managing floor content and offerings in accordance with operator selections or automatically depending upon CMS 807 and SMS 805 master programming. The data and programming updates to gaming machines 803 are authenticated using conventional techniques prior to install on the system components.

In various embodiments, any of the gaming machines 803 may be a mechanical reel spinning slot machine or a video slot machine or a gaming machine offering one or more of the above-described games including a group play game. Alternately, gaming machines 803 may provide a game with a simulated musical instrument interface as a primary or base game or as one of a set of multiple primary games selected for play by a random number generator. A gaming system of the type described above also allows a plurality of games in accordance with the various embodiments to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

The various embodiments and examples described above are provided by way of illustration only and should not be construed to limit the invention, nor the scope of the various embodiments and examples. Those skilled in the art will readily recognize various modifications and changes that may be made to the invention without following the example embodiments and applications illustrated and described herein, and without departing from the true spirit and scope of the disclosed embodiments, which are set forth in the following claims.

What is claimed:

1. A computer-implemented method for playing a secondary game in association with a primary wagering game, the method comprising:

presenting a simulated musical interface on the gaming machine associated with one or more activatable regions on which the one or more activatable regions associated with the simulated musical interface are activatable by a player;

providing graphical representations on the display of the gaming machine upon the player activating an activatable region associated with the simulated musical interface; and generating one or more outcomes for the secondary game based on the player's activation of the one or more activatable regions associated with the simulated musical interface and the graphical representations.

2. The method of claim 1, wherein the simulated musical interface is presented on the display, and wherein the display utilizes touch screen technology.

3. The method of claim 1, wherein the simulated musical interface is presented on the display, and wherein the one or more activatable regions are associated with one or more wagering buttons associated with the primary wagering game.

4. The method of claim 1, wherein the simulated musical interface is presented on a touch screen button deck.

5. The method of claim 1, wherein the one or more activatable regions are video representations of a plurality of piano or synthesizer keys.

6. The method of claim 1, wherein the secondary game is a bonus game, a component associated with the primary game that must be triggered to obtain certain results from the primary game, a tournament game, or a collaborative game.

7. The method of claim 1, wherein the one or more trigger events are based on one or more player inputs, one or more primary game results, one or more bonus game results, one or more tournament game results, player points, tournament points, game specific points, accumulation of game pieces across multiple gaming machines, or any combination thereof.

8. The method of claim 1, further comprising affecting how long the simulated musical interface is presented to the player based on the manner in which the secondary game is triggered.

9. The method of claim 1, further comprising indicating when the one or more activatable regions associated with the simulated musical interface should be activated by the player in relation to other one or more activatable regions.

10. The method of claim 9, further comprising presenting one or more reels with or without indicia thereon.

11. The method of claim 10, further comprising activating one or more activatable regions by the player.

12. The method of claim 11, further comprising adding one or more indicia on the one or more reels when the player activates one or more of the activatable regions.

13. The method of claim 11, further comprising presenting one or more graphical representations on the display when the player activates one or more of the activatable regions.

14. The method of claim 13, further comprising transforming the one or more graphical representations on the display into indicia that are added to the one or more reels.

15. The method of claim 14, further comprising spinning the one or more reels.

16. A computer-implemented gaming machine comprising:

a display for presenting a primary game and a bonus game to a player; and one or more player input devices for receiving player input, wherein at least one of the one or more player input devices is configurable to operate as a simulated musical interface on the gaming machine, and wherein the simulated musical interface has one or more regions that are activatable by the player;

wherein graphical representations are presented on the display of the gaming machine, and wherein one or more outcomes for the secondary game are generated based on the player's activation of the one or more activatable regions associated with the simulated musical interface and the graphical representations.

17. The gaming machine of claim 16, wherein the one or more trigger events are based on one or more player inputs, one or more primary game results, one or more bonus game results, one or more tournament game results, player points, tournament points, game specific points, accumulation of game pieces across multiple gaming machines, or any combination thereof.

18. The gaming machine of claim 16, wherein one or more reels are associated with the bonus game and when the player activates one or more activatable regions, indicia is added to the one or more reels.

19. The gaming machine of claim 16, wherein one or more reels are associated with the bonus game and when the player activates one or more activatable regions, graphical representations of musical notes, symbols, or objects are presented on the display of the gaming machine.

20. The gaming machine of claim 18, wherein the graphical representations are transformed into random numerical representations and added to the one or more reels.

21. The gaming machine of claim 19, wherein the one or more reels are spun to generate a randomized outcome.

22. A computer-implemented gaming system comprising:

a plurality of gaming machines connected to a server over a network, wherein each gaming machine has a simulated musical interface, wherein the simulated musical interface of each gaming machine has one or more regions that are activatable by a player, wherein graphical representations are presented on each gaming machine, and wherein one or more outcomes for the secondary game are generated based on the player's activation of the one or more activatable regions associated with the simulated musical interface and the graphical representations; and a collaborative or tournament game presented on the plurality of gaming machines or a group within the plurality of gaming machines, wherein the simulated musical interface is associated with the collaborative or tournament game.

* * * * *

UNITED STATES PATENT AND TRADEMARK OFFICE

CERTIFICATE OF CORRECTION

PATENT NO. : 8,651,938 B2
APPLICATION NO. : 13/735538
DATED : February 18, 2014
INVENTOR(S) : Barry Iremonger et al.

It is certified that error appears in the above-identified patent and that said Letters Patent is hereby corrected as shown below:

In the Specification

Column 3, In line 20, add --S-- to "DRAWING"

Column 5, In line 29, after "concert" change "grant" to --grand--

Column 20, In line 60, after "like" delete "."

Signed and Sealed this
Thirteenth Day of May, 2014

Michelle K. Lee

Michelle K. Lee
*Deputy Director of the United States Patent and Trademark Office*